US006591511B1

(12) United States Patent
Carroll et al.

(10) Patent No.: US 6,591,511 B1
(45) Date of Patent: Jul. 15, 2003

(54) FRAMING SQUARE

(75) Inventors: Timothy B. Carroll, Tallahassee, FL (US); John Wiley Horton, Monticello, FL (US); Stephen M. Marshall, Tallahassee, FL (US)

(73) Assignee: Trinvent, Inc., Tallahassee, FL (US)

( * ) Notice: Subject to any disclaimer, the term of this patent is extended or adjusted under 35 U.S.C. 154(b) by 0 days.

(21) Appl. No.: 10/039,559

(22) Filed: Jan. 8, 2002

(51) Int. Cl.[7] ..... B43G 7/027

(52) U.S. Cl. ..... 33/474; 33/415; 33/417; 33/484; 33/486; 33/427; 33/416; 33/481; 33/485; 33/464

(58) Field of Search ..... 33/474, 415, 417, 33/484, 486, 427, 416, 481, 485, 419, 464

(56) References Cited

U.S. PATENT DOCUMENTS

| | | | | | |
|---|---|---|---|---|---|
| 935,067 | A | * | 9/1909 | Taylor | 33/427 |
| 2,720,706 | A | * | 10/1955 | Laine | 33/427 |
| 2,805,484 | A | * | 9/1957 | D'Aoust | 33/485 |
| 2,872,735 | A | * | 2/1959 | Roberts | 33/427 |
| 3,623,232 | A | * | 11/1971 | Mahlstadt | 33/427 |
| 4,513,510 | A | * | 4/1985 | Swanson | 33/427 |
| 4,641,435 | A | * | 2/1987 | Brown | 33/474 |
| 5,539,991 | A | * | 7/1996 | Harrison | 33/471 |
| 5,813,126 | A | * | 9/1998 | Dahl | 33/474 |
| 5,915,808 | A | * | 6/1999 | Stringari | 33/474 |
| 6,070,334 | A | * | 6/2000 | Pretsch, Jr. | 33/474 |
| 6,233,835 | B1 | * | 5/2001 | Brown et al. | 33/484 |

FOREIGN PATENT DOCUMENTS

| | | | | |
|---|---|---|---|---|
| FR | 2652305 | A | * 9/1989 | B43L/7/02 |

* cited by examiner

*Primary Examiner*—Diego Gutierrez
*Assistant Examiner*—Amanda J Hoolahan
(74) *Attorney, Agent, or Firm*—J. Wiley Horton

(57) ABSTRACT

An improved framing square having integral features for automating the marking and cutting of angles. The square contains two sliding carriages—one in the body and one in the blade. Each carriage has a deployable pin. In order to set an angle, the user first deploys the pins in each sliding carriage so that they protrude downward from the square. Next, the user sets the sliding carriage in the body to the desired position and locks it in place. The user then sets the sliding carriage in the blade to the desired position and locks it in place. The two pins protruding from the sliding carriages are then butted against the board to be cut. Once they are in place, the blade of the square will form the correct cutting angle across the board. Since many common cuts employ a twelve inch base leg, the invention includes another feature: Rather than set the sliding carriage within the body to twelve inches, the user may opt instead to deploy a fixed pin located in the body at the twelve inch position. The user then only needs to adjust the sliding carriage within the blade to create a "3 in 12","5 in 12","7 in 12", or other desired angle. A second fixed pin is provided at the seventeen inch position on the body. This pin corresponds to the base length commonly used for making hip rafters.

5 Claims, 11 Drawing Sheets

FRAMING SQUARE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of measurement and marking. More specifically, the invention comprises an improved framing square incorporating fixed pins and slidable carriages which allow the user to more easily mark desired angles on objects to be cut.

2. Description of the Related Art

Carpentry framing squares have been in common use for over a century. Most squares are composed of two legs forming a right angle. The longer leg is generally referred to as the "body", with the shorter leg being referred to as the "blade." Both the body and blade are typically marked with scales along their edges. These scales allow the user to mark desired cutting angles on lumber. However, the use of the scales is somewhat cumbersome since the user must visually align the marks on the scale with the edge of the lumber.

The limitations inherent in the visual alignment approach have been recognized for many years. U.S. Pat. No. 503,050 to Lantz (1893) discloses a solution to this problem which is now in common use. The Lantz invention employs two sliding stops which are clamped to the edges of the framing square. These stops incorporate fixed reference points which are butted against the edge of the board to be cut.

Carpenters must often make many repetitive cuts. If, for example, roofing rafters are being cut to length, then the carpenter might make fifty "3 in 12" cuts in a row. The Lantz device is effective in this scenario. Once the carpenter has set the sliding stops in the correct position, the square may be butted against each successive board and the correct cutting angle will result. Unfortunately, however, the clamps disclosed in Lantz must be removed prior to using the square for other purposes. They are then often lost or damaged. Thus, the prior art devices for automating the marking of cutting angles using a framing square contain inherent limitations.

BRIEF SUMMARY OF THE INVENTION

The present invention comprises an improved framing square having integral features for automating the marking and cutting of angles. The square contains two sliding carriages—one in the body and one in the blade. Each carriage has a deployable pin. In order to set an angle, the user first deploys the pins in each sliding carriage so that they protrude downward from the square. Next, the user sets the sliding carriage in the body to the desired position and locks it in place. The user then sets the sliding carriage in the blade to the desired position and locks it in place. The two pins protruding from the sliding carriages are then butted against the board to be cut. Once they are in place, the blade of the square will form the correct cutting angle across the board.

Since many common cuts employ a twelve inch base leg, the invention includes another feature: Rather than set the sliding carriage within the body to twelve inches, the user may opt instead to deploy a fixed pin located in the body at the twelve inch position. The user then only needs to adjust the sliding carriage within the blade to create a "3 in 12", "5 in 12", "7 in 12", or other desired angle. A second fixed pin is provided at the seventeen inch position on the body. This pin corresponds to the base length commonly used for making hip rafters.

REFERENCE NUMERALS IN THE DRAWINGS

| | | | |
|---|---|---|---|
| 10 | body housing | 12 | blade housing |
| 14 | lower laminate | 16 | upper laminate |
| 18 | improved framing square | 20 | body carriage |
| 22 | blade carriage | 24 | blade slot |
| 26 | body slot | 28 | thumb relief |
| 30 | first pin | 32 | second pin |
| 34 | pin housing | 36 | retaining trunnion |
| 38 | trunnion way | 40 | carriage pin |
| 42 | registration protrusion | 44 | registration hole |
| 46 | carriage way | 48 | pin hole |
| 50 | camming pin | 52 | paddle |
| 54 | carriage stop | 56 | camming pin lock |
| 58 | chassis | 60 | carriage pin housing |
| 64 | pin relief | 66 | pin journal |
| 68 | journal slot | 70 | friction disks |
| 72 | 2 × 6 | 74 | camming surface |
| 76 | spring bore | 78 | reference surface |
| 80 | 2 × 12 | 82 | cut marks |

DETAILED DESCRIPTION OF THE INVENTION

Figure 1:
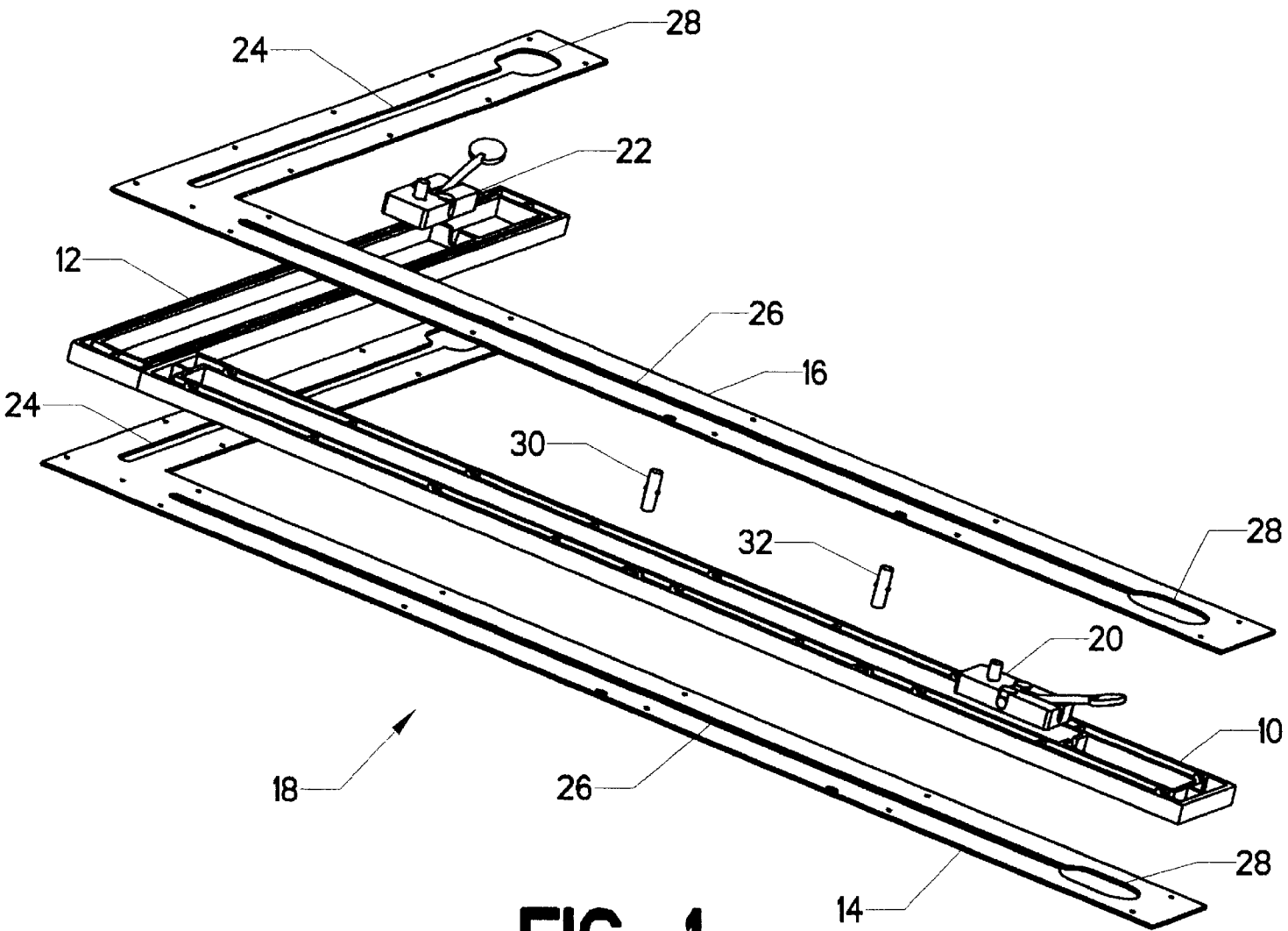
FIG. 1 is an isometric view, showing the major components of the present invention.

FIG. 1 illustrates the major components of the invention. Improved framing square 18 is constructed in three main layers. At the bottom (in the view as shown) is lower laminate 14. This is typically made of thin aluminum. It has the same shape as a prior art square; i.e., a body and a blade connected at right angles to form an "L" shape. The middle layer is formed by body housing 10 and blade housing 12.

These two pieces are typically made from injection-molded plastic, In order to minimize the size of the mold, the middle layer is formed from two separate components which, when combined, also form an "L" shape. This middle layer could also be formed as one integrally-molded piece.

Figure 4:
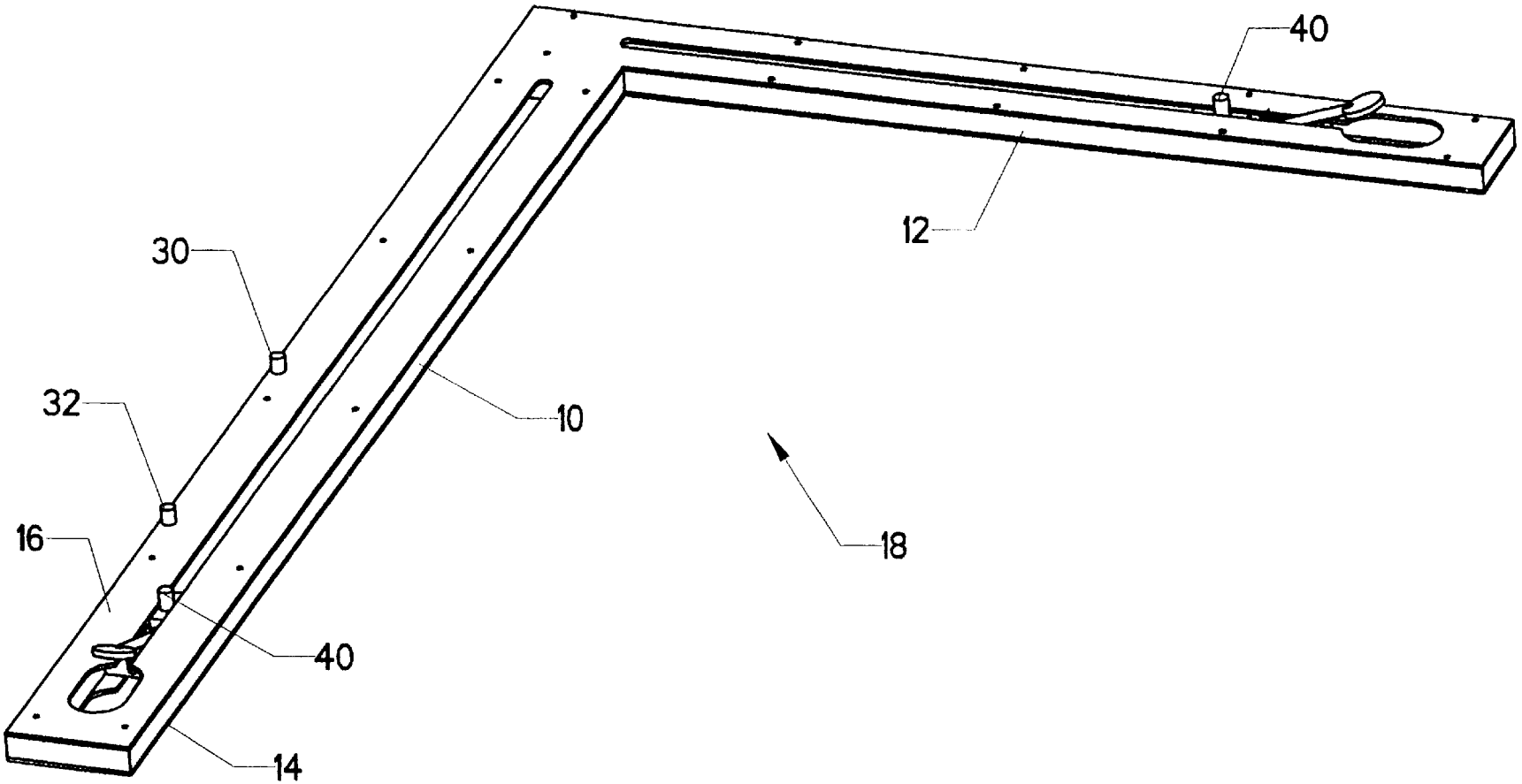
FIG. 4 is an isometric view, showing the assembled invention.

At the top is upper laminate 16. Upper laminate 16 is identical to lower laminate 14. The layers described are bonded together to form a completed square—as shown in FIG. 4. Returning now to FIG. 1, the reader will appreciate that this type of construction creates hollow cavities within improved framing square 18. Body carriage 20 is slidably mounted within the interior of body housing 10. Likewise, blade carriage 22 is slidably mounted within blade housing 12. Both upper laminate 16 and lower laminate 14 open into blade slots 24 and body slots 26. These slots provide access to certain features of the sliding carriages—as will be explained subsequently. Both laminates also open into thumb reliefs 28. Thumb reliefs 28 allow access to other features of the sliding carriages.

First pin 30 and second pin 32 are housed within body housing 10. First pin 30 is located on the outside edge of the square, at a distance of twelve inches from the vertex of the right triangle. Second pin 32 is also located on the outside edge of the square, at a distance of seventeen inches from the vertex.

Figure 2:
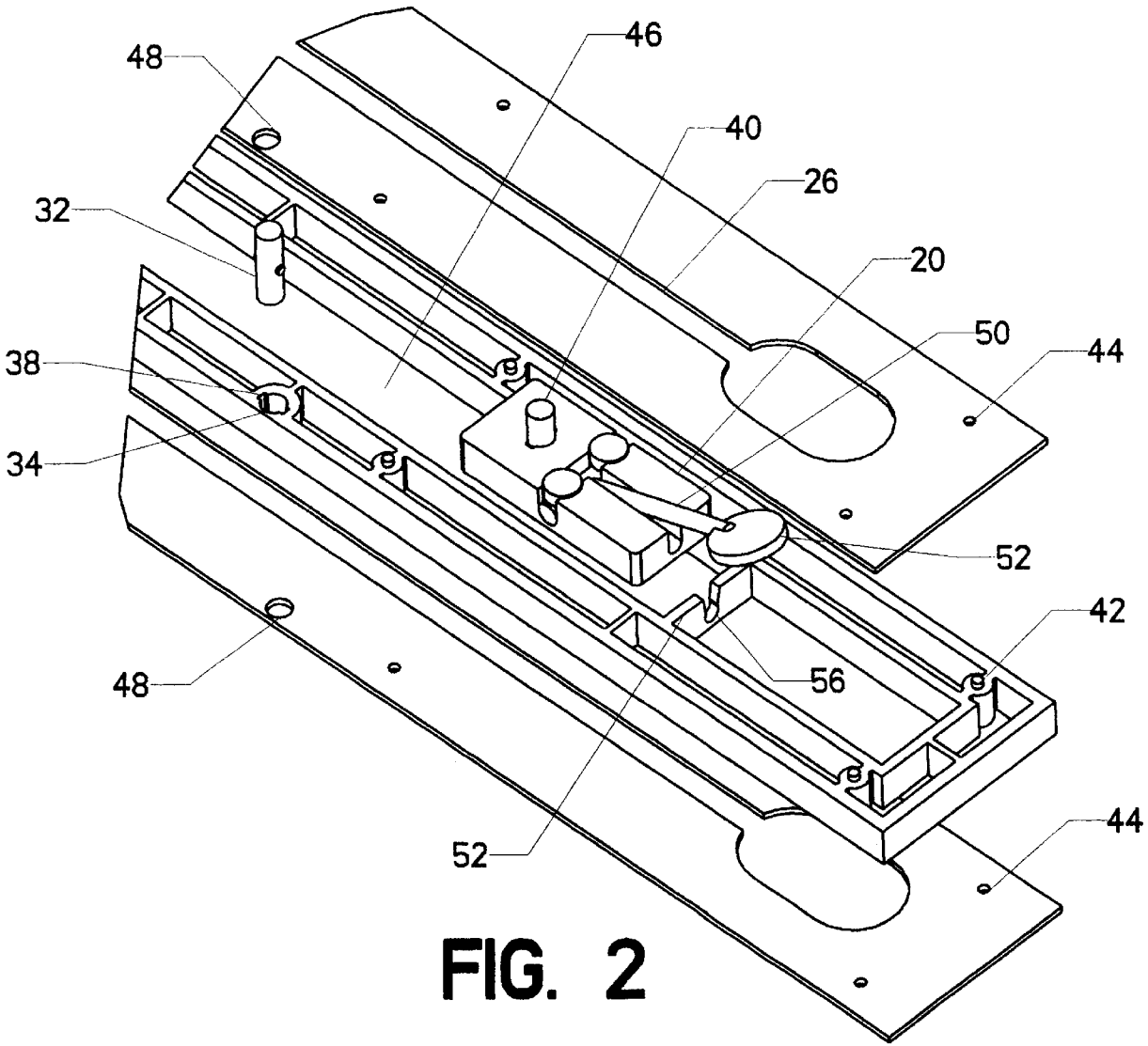
FIG. 2 is a detail view, showing some internal features.

FIG. 2 shows some of the internal features in greater detail. The reader will observe that second pin 32 fits within second pin housing 34. Corresponding pin holes 48 are found in both laminates. Second pin 32 is considerably taller than the thickness of the completed assembly. Thus, as it moves up and down within second pin housing 34, it will stick out one side of improved framing square 18 or the other. Without additional features, of course, second pin 32 would tend to fall out completely. Retaining trunnions 36 are provided to prevent this. Two retaining trunnions 36 are provided, one on each side of second pin 32. Two trunnion ways 38 are also provided in pin housing 34. The reader will note, however, that no trunnion ways are provided in pin holes 48. Thus, second pin 32 is free to move up and down until its two retaining trunnions 36 are stopped by upper laminate 16 or lower laminate 14.

Second pin 32 is a close frictional fit within pin housing 34. Thus, if the user presses the pin up or down, it tends to remain in that position until moved again. First pin 30 is made in the identical fashion—including a corresponding pin housing, trunnion way, etc. Carriage pin 40 is likewise identical. The above-described method of capturing the components within body housing 10 and blade housing 12 by using the two laminates is employed for nearly all the components in the invention—as will be described.

A series of registration protrusions 42 are arrayed around the upper and lower surfaces of body housing 10 and blade housing 12. These correspond in location to a series of registration holes 44 in the two laminates. These features line up the components during assembly. The assembly can then be glued or ultrasonically welded together. Mechanical fasteners could also be employed, though this would obviously add complexity.

Body carriage 20 slides back and forth within carriage way 46. It is locked in a desired position via the action of camming pin 50. When camming pin 50 is in the position shown, body carriage 20 is free to slide. When it is rotated toward the vertical, however, it locks body carriage 20 in position.

Carriage stop 54 provides a "home" position for body carriage 20. As body carriage 20 moves toward the right, it will come up against carriage stop 54 and thereby be arrested. Camming pin 50 may then be pushed downward, where it will snap into camming pin lock 56. Camming pin lock 56 is a frictional engagement which holds body carriage 20 in place. Paddle 52 is provided on the end of camming pin 50 so that the user can more easily manipulate the device. Thumb reliefs 28 (see FIG. 1) are provided so that the user may grasp paddle 52 when camming pin 50 is locked into its home position. Identical features are found regarding the placement of blade carriage 22 within blade housing 12.

Figure 3:
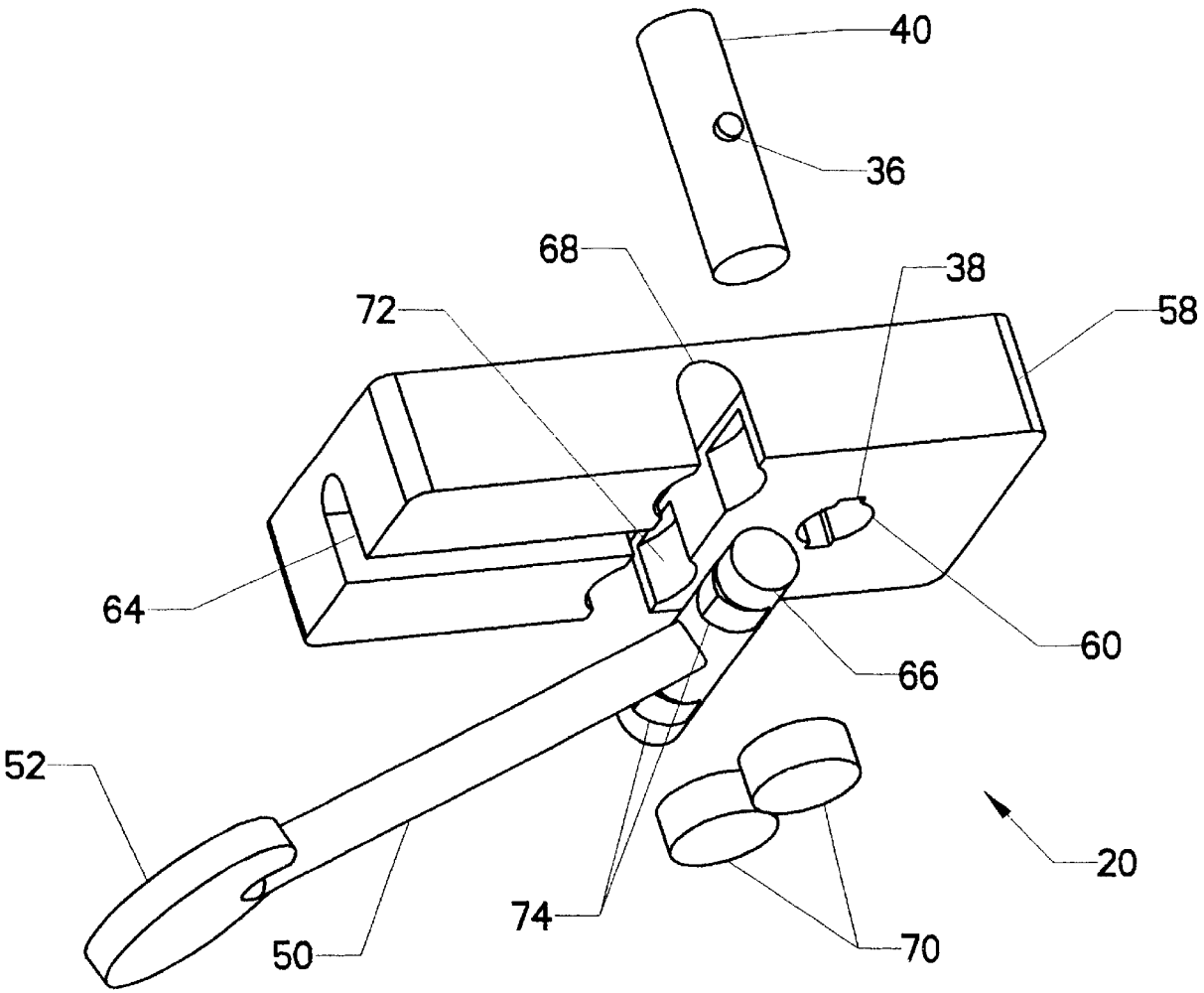
FIG. 3 is an isometric view, showing the components of the sliding carriages.

FIG. 3 is an exploded view illustrating the components of body carriage 20 (note that blade carriage 22 is absolutely identical). Chassis 58 mounts the components. Carriage pin 40 slides up and down within carriage pin housing 60. As for second pin 32, carriage pin 40 has a pair of retaining trunnions 36 and carriage pin housing 60 has a pair of trunnion ways 38. Thus, when the device is assembled within improved framing square 18. The user is free to push carriage pin 40 out the top or out the bottom, until its travel is limited by its retaining trunnions 36. Being another frictional fit, it tends to stay where the user places it.

Camming pin 50 is placed into chassis 58 by placing pin journal 66 into journal slot 68. When camming pin 50 is rotated completely upward in the view shown, it rests within pin relief 64. Once camming pin 50 is in place, two friction disks 70 are installed within disk receivers 72. Pin journal. 66 is equipped with camming surfaces 74. When camming pin 50 is rotated downward (in the view as shown), camming surfaces 74 push friction disks 70 out of chassis 58.

Returning now to FIG.2, the reader should be aware that body carriage 20 is a close fit within carriage way 46. If paddle 52 is lifted up from the position shown in the view, the two friction disks 70 will bear against the underside of upper laminate 16. This action will frictionally lock body carriage 20 in place. Returning to FIG. 3, the reader should be aware that an over-center action is provided on camming surfaces 74. This feature ensures that when camming pin 50 is rotated completely down in the view as shown, it will "snap" into that position and remain there.

FIG. 4 shows the assembled improved framing square 18, with lower laminate 14, body housing 10, blade housing 12, and upper laminate 16 in place. Both carriages are in their respective "home" positions. Ordinarily, both paddles 52 would be snapped down within the inside of their respective housings. As shown, the user has lifted the two paddles 52 out of the thumb reliefs 28 in order to free the carriages for movement. The user may now move the carriages by grasping the two paddles 52. Once a desired position is reached, the user lifts a paddle 52 upright, thereby frictionally locking that carriage in place.

FIG. 4 shows the four pins which are the key to the invention's operation: (1) first pin 30; (2) second pin 32; (3) carriage pin 40 within body carriage 20; and (4) carriage pin 40 within blade carriage 22. All these pins are preferably identical—for manufacturing simplicity. All these pins are also capable of being pushed up out of the top side of improved framing square 18, or pushed down out of the bottom side. This feature allows the user to employ the square in a left-handed or right-handed fashion—as will be explained.

Figure 5:
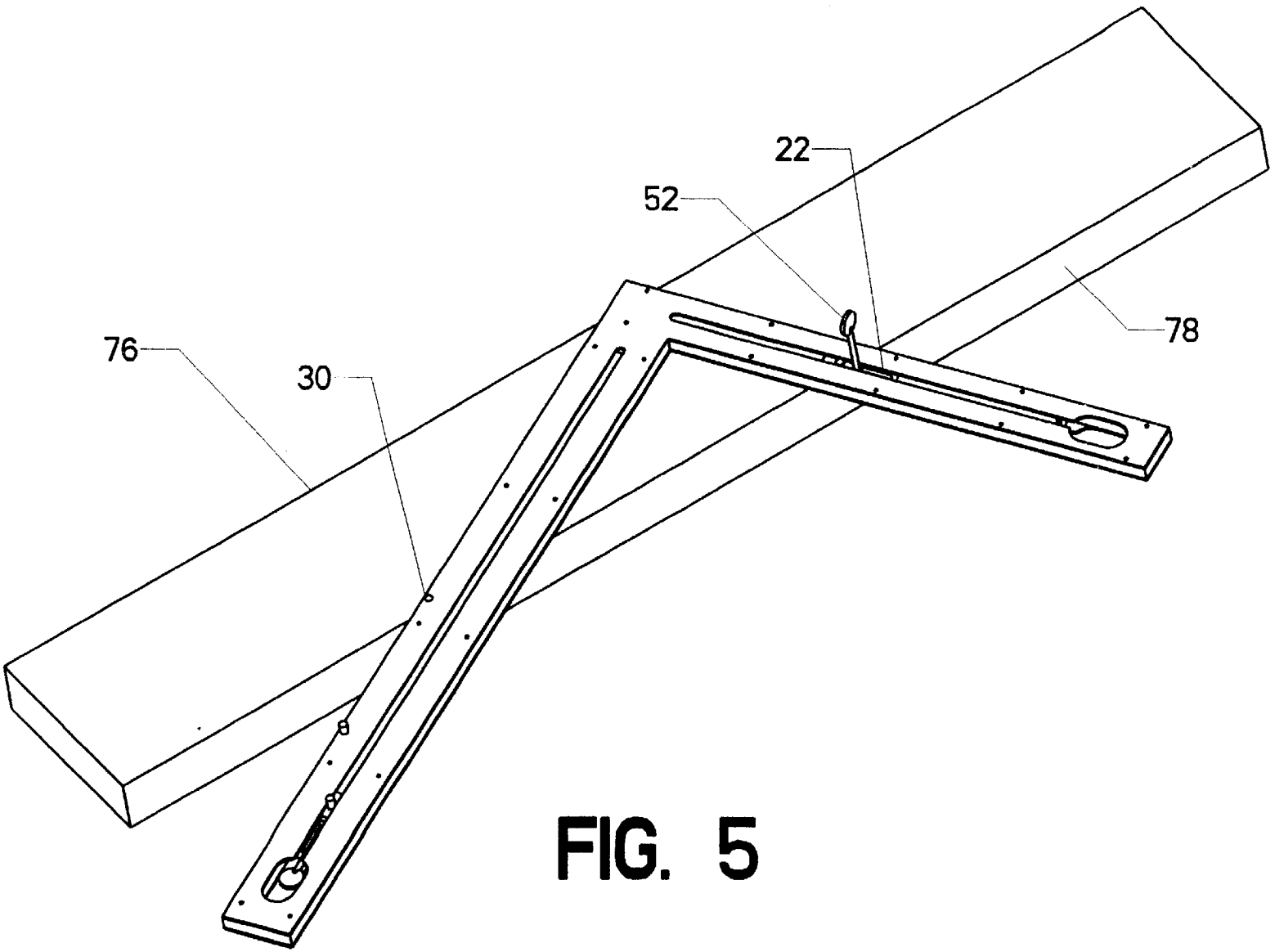
FIG. 5 is an isometric view, showing the use of the invention to mark an angled cut.

FIG. 5 shows the application of the square to 2×6 76. The reader will observe that 2×6 76 is an article having a generally rectangular cross section. The square is placed on a surface to be marked. A perpendicular reference surface 78 must also be present. In this example, the user wishes to scribe a cut line which is appropriate for a 9 in 12 pitch (rise of 9 inches over a run of 12 inches). The user starts by pressing down first pin 30 (corresponding to the 12" location). Next, the user then presses down carriage pin 40 in blade carriage 22. The user presses first pin 30 against reference surface 78, then uses it as a pivot point to pivot the square until a 9 inch reading is observed along the blade scale. The user then slides blade carriage 22 forward until the carriage pin 40 within blade carriage 22 rests against reference surface 78. The user then lifts paddle 52 to the vertical position, thereby locking blade carriage 22 in place. Alternatively—a scale can be provided for measuring the travel of blade carriage 22. The user can then preset the position of blade carriage 22 before bringing the invention into contact with reference surface 78.

Figure 6:
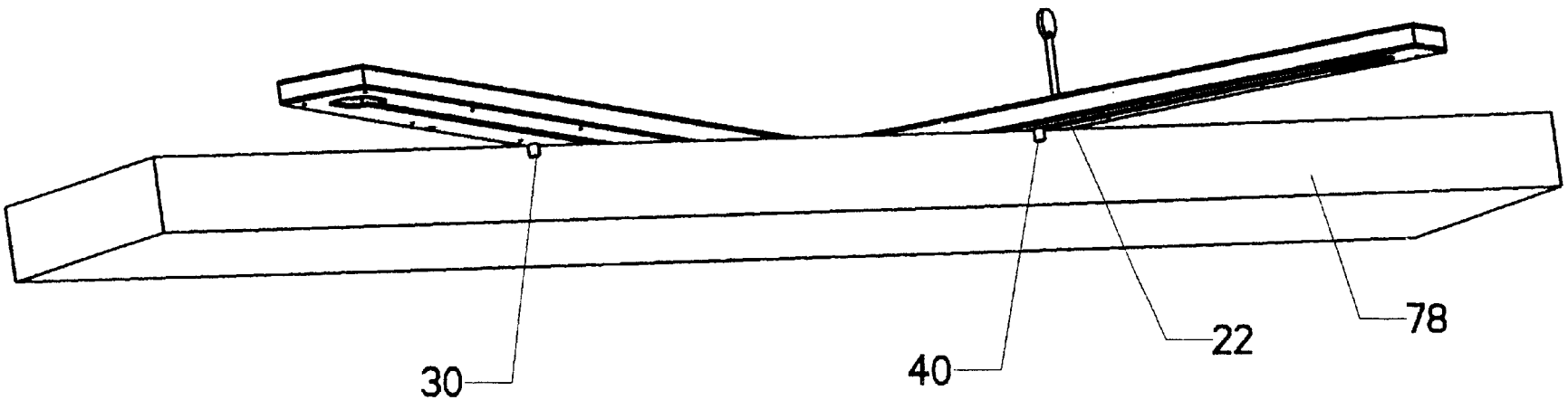
FIG. 6 is an isometric view, showing the use of the invention to mark an angled cut.

The reader will observe that an angular relationship between the square and 2×6 76 has therefore been established. This may be observed in FIG. 6, which shows the same assembly from the underside. The reader will observe that first pin 30 and the carriage pin 40 within blade carriage 22 are hard against reference surface 78. The user can them mark the appropriate cut. The user can also leave the square as set while marking a whole series of cuts. Upon completion, blade carriage 22 is locked back into its home position and improved framing square 18 can then be used like any other prior art square.

Second pin 32 provides an identical function in combination with blade carriage 22, except that it provides angles having a base leg of seventeen inches ("5 in 17", "9 in 17", etc.). Those skilled in the art will know that a seventeen inch base leg is often used for making hip rafters and the like.

Certain marking function require an infinitely variable angular measurement. This is particularly true for stair case stringers. Stair treads are now standardized. However, carpenters must often compensate for the fact that floors are separated by inexact distances. A carpenter might ideally want to install 14 treads with 14 risers having a height of 9 inches. However, upon inspection, the carpenter may need to adjust the riser height to 8.950 inches. Thus, infinite variations are possible. Body carriage 20 is provided to account for this possibility.

Figure 7:
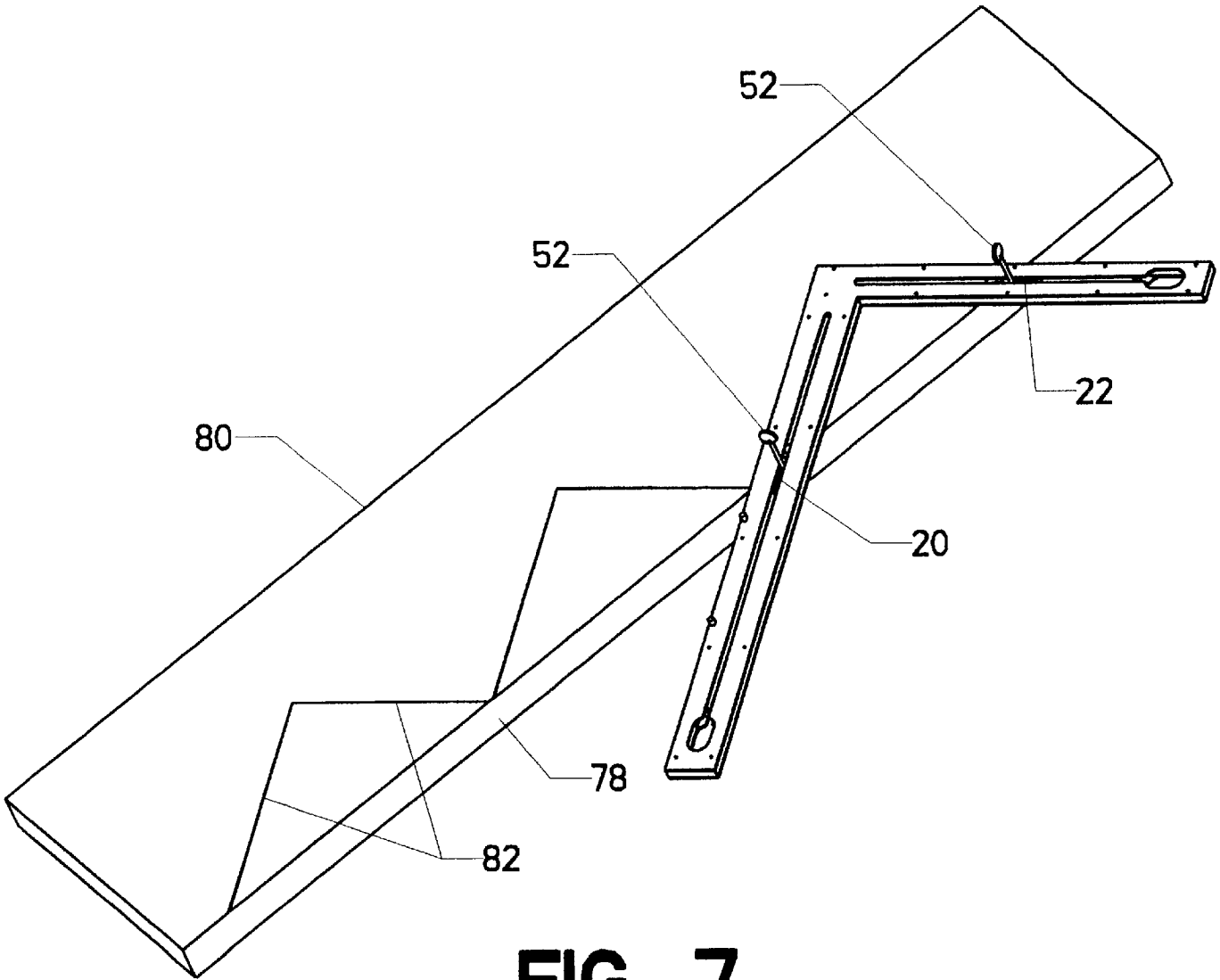
FIG. 7 is an isometric view, showing the use of the invention to mark a staircase stringer.

FIG. 7 shows the present invention being used to mark cuts in a staircase stringer. These cuts follow a repeating sawtooth pattern—providing notches to receive the staircase treads and risers. In order to create this pattern, the user first places the square in the correct position on 2×12 80 using the prior art scales printed along its edges. The user then deploys the two carriage pins 40 downward. Next, the user releases body carriage 20 and blade carriage 22 and advances them until the two carriage pins 40 rest against reference surface 78. The user then locks the two carriages in position as described previously. Finally, the user makes a series of cut marks 82 by advancing the square down 2×12 80. Alternatively, scales showing the position of both carriages could be employed to preset the carriage positions before positioning the square.

Figure 8:
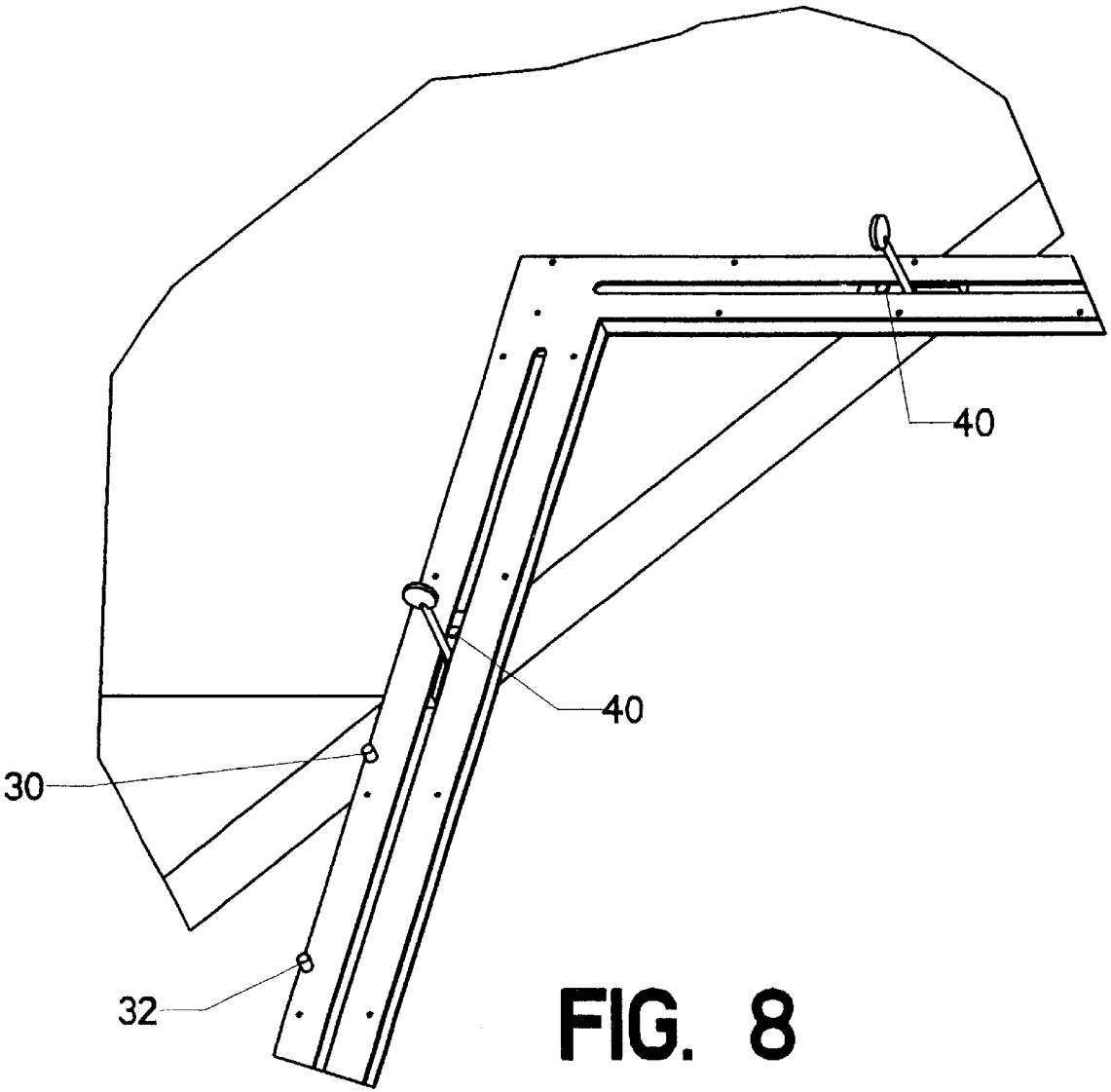
FIG. 8 is an isometric view, showing the use of the invention to mark a staircase stringer.
Figure 9:
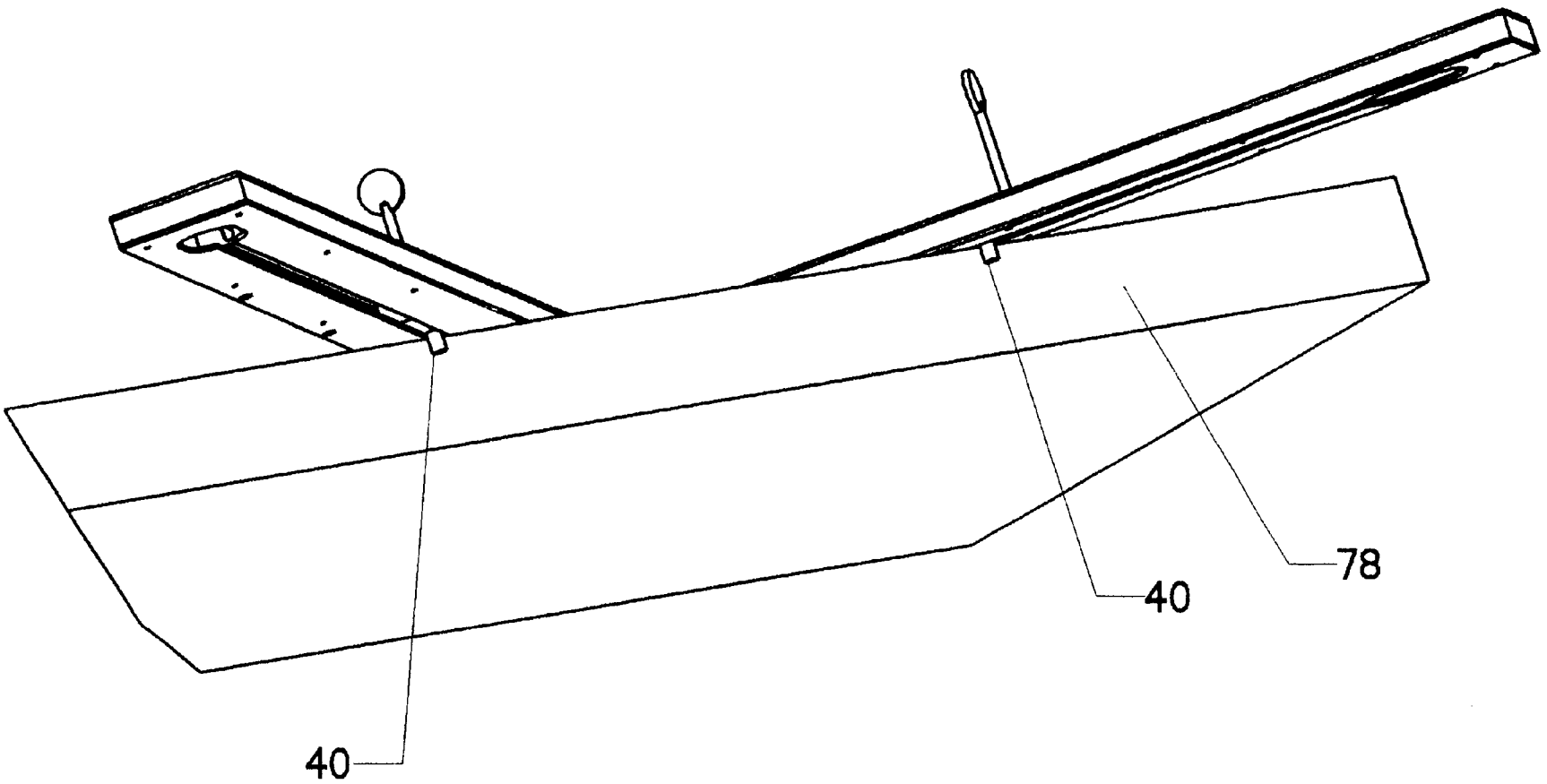
FIG. 9 is an isometric view, showing the use of the invention to mark a staircase stringer.

FIG. 8 shows a detail view. The reader will observe that first pin 30 and second pin 32 are lifted out of the way (they are not used). The two carriage pins 40 are shown pushed down into position. FIG. 9 shows the same assembly from the underside. The reader will observe how the two carriage pins 40 fix the position of the square against reference surface 78.

Returning now to FIG. 7, the ambidextrous functionality of the invention will be explained. Right-handed users typically grasp the square by the body portion (the longer leg) using the left hand. This leaves the right hand free for using a marking pencil. Thus, FIG. 7 shows a right-handed use of the invention. Left-handed carpenters prefer to grasp the body portion with the right hand and use the left hand for marking. This requires the square to be flipped over with respect to the view shown in FIG. 7. As prior art squares are generally pieces of solid metal with printing on both sides, this need for ambidexterity is not a problem. It is important for the present invention to have this capability as well.

Figure 10:
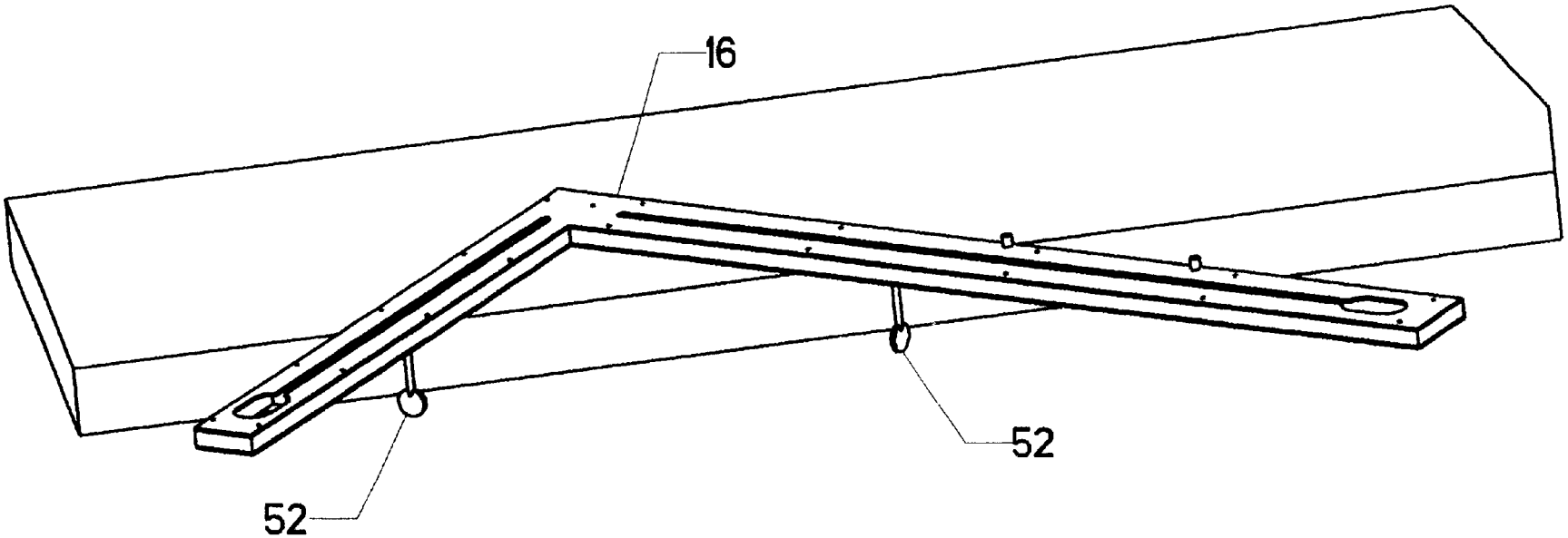
FIG. 10 is an isometric view, showing how the invention may be used in a right handed or orientation.
Figure 11:
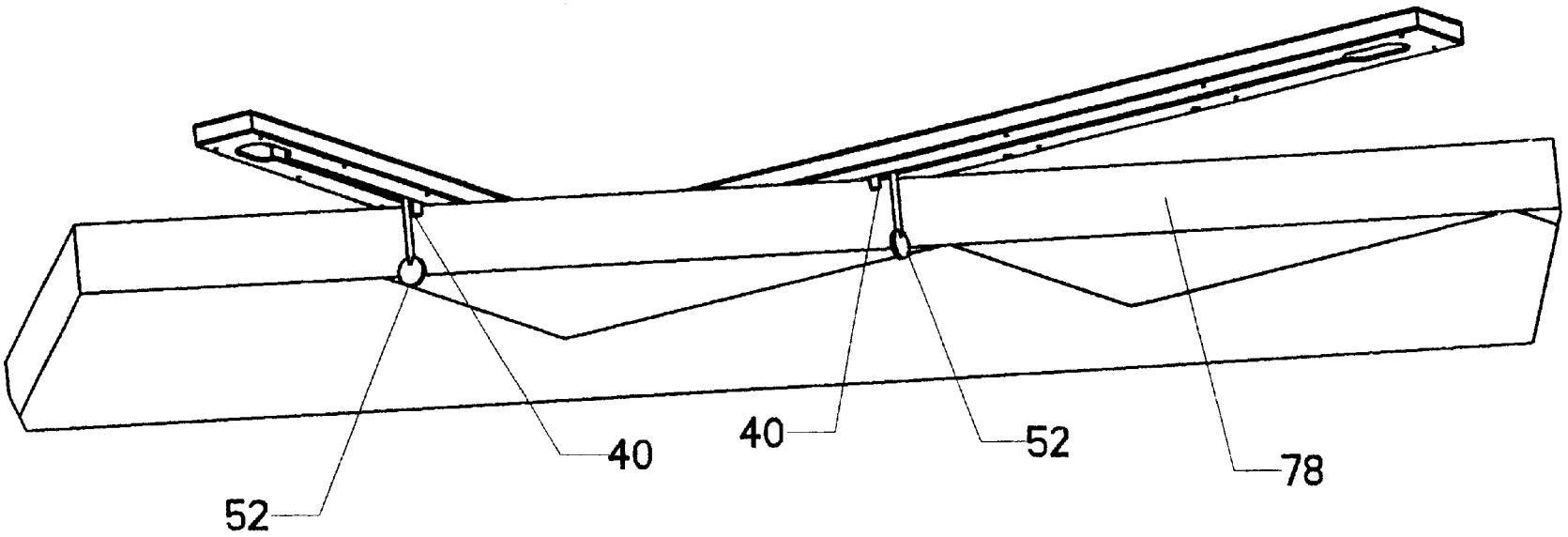
FIG. 11 is an isometric view, showing how the invention may be used in a right handed or orientation.

FIG. 10 shows the square flipped over in a left-handed configuration. The reader will observe that the two paddles 52 must then be deployed downward. FIG. 11 shows the same configuration from the underside. The fact that the two carriage pins 40 are closer to reference surface 78 than the deployed paddles 52 means that the paddles are not an obstacle to use. Thus, in a right-handed configuration the paddles will be deployed upward, whereas in a left-handed configuration, the paddles will be deployed downward. All the pins are designed to be deployed either upward or downward at the user's choice.

Having read the preceding descriptions, the reader will understand that the preferred embodiment:

1. Greatly simplifies the marking of repetitive angles for cutting;
2. Can be used in a left-handed or right-handed configuration;
3. Provides for the convenient marking of angles having a base leg of 12 inches;
4. Provides for the convenient marking of angles having a base leg of 17 inches; and
5. Provides for the convenient marking of staircase stringer.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described our invention, we claim:

1. An improved framing square for measuring cuts to be made on an article, wherein said article includes a surface to be marked and a reference surface lying perpendicular thereto, comprising:

a. a body;

b. a blade lying perpendicular to said body;

c. a first pin disposed within said body, wherein said first pin is deployable from a stowed position, where said first pin does not protrude beyond said body in a direction facing said surface to be marked, to a protruding position where said first pin will bear against said reference surface when said body is placed on said surface to be marked;

d. a first sliding carriage, slidably movable within said blade, wherein said first sliding carriage includes a first carriage pin deployable from a stowed position, where said first carriage pin does not protrude beyond said body in a direction facing said surface to be marked, to a protruding position where said first carriage pin will bear against said reference surface when said body is placed on said surface to be marked; and e. means to lock said first sliding carriage in a desired position, so that said first pin and said first carriage pin will bear against said reference surface and fix said improved framing square at a desired angle relative to said article.

2. An improved framing square for measuring cuts to be made on an article, wherein said article includes a surface to be marked and a reference surface lying perpendicular thereto, comprising:

a. a body;

b. a blade lying perpendicular to said body;

c. a first sliding carriage, slidably movable within said blade, wherein said first sliding carriage includes a first carriage pin deployable from a stowed position, where said first carriage pin does not protrude beyond said body in a direction facing said surface to be marked, to a protruding position where said first carriage pin will bear against said reference surface when said body is placed on said surface to be marked; and d. means to lock said first sliding carriage in a desired position, so that said first carriage pin will bear against said reference surface and fix said improved framing square at a desired location relative to said article.

3. An improved framing square as recited in claim 2, further comprising:

a. a second sliding carriage, slidably movable within said body, wherein said second sliding carriage includes a second carriage pin deployable from a stowed position, where said second carriage pin does not protrude beyond said body in a direction facing said surface to be marked, to a protruding position where said second carriage pin will bear against said reference surface when said body is placed on said surface to be marked; and b. means to lock said second sliding carriage in a desired position, so that said second carriage pin will bear against said reference surface and, in conjunction with said first carriage pin, fix said improved framing square at a desired angle relative to said article.

4. An improved framing square for measuring cuts to be made on an article, wherein said article includes a surface to be marked and a reference surface lying perpendicular thereto, comprising:

a. a body;

b. a blade lying perpendicular to said body;

c. a first pin disposed within said body, wherein said first pin is deployable from a stowed position, where said first pin does not protrude beyond said body in a direction facing said surface to be marked, to a protruding position where said first pin will bear against said reference surface when said body is placed on said surface to be marked, so that said first pin will provide a pivot point about which said improved framing square can be rotated to a desired position.

5. An improved framing square as recited in claim 4, further comprising a second pin disposed within said body at a location separate from said first pin, where said second pin is deployable from a stowed position, where said second pin does not protrude beyond said body in a direction facing said surface to be marked, to a protruding position where said second pin will bear against said reference surface when said body is placed on said surface to be marked, so that said second pin may be deployed instead of said first pin so that said second pin will provide an alternate pivot point about which said improved framing square can be rotated to a desired position.

* * * * *